United States Patent [19]

Stahl et al.

[11] 4,313,685

[45] Feb. 2, 1982

[54] PUSH-BUTTON SWITCH, PARTICULARLY FOR KEYBOARDS OF TYPEWRITERS AND SIMILAR DEVICES

[75] Inventors: Horst Stahl, Weidach; Walter Wachs, Krailling, both of Fed. Rep. of Germany

[73] Assignee: Siemens Aktiengesellschaft, Berlin & Munich, Fed. Rep. of Germany

[21] Appl. No.: 98,406

[22] Filed: Nov. 29, 1979

[30] Foreign Application Priority Data

Dec. 14, 1978 [DE] Fed. Rep. of Germany ..... 2854096

[51] Int. Cl.[3] ..... B41J 5/08

[52] U.S. Cl. ..... 400/479; 400/491.2; 200/159 R; 200/276

[58] Field of Search ..... 400/472, 479, 491.2, 400/495.1; 200/5 A, 159 R, 159 A, 276, 340

[56] References Cited

U.S. PATENT DOCUMENTS

| | | | |
|---|---|---|---|
| 1,610,835 | 12/1926 | Westburg et al. | 200/159 R X |
| 1,629,896 | 5/1927 | Valerius | 200/159 R |
| 3,379,851 | 4/1968 | Weremey | 200/159 R |
| 3,842,229 | 10/1974 | Boulanger | 200/159 R |
| 3,842,230 | 10/1974 | Kashio et al. | 200/5 A X |
| 3,964,593 | 6/1976 | Pointon | 400/479 X |
| 4,092,503 | 5/1978 | Raeder | 200/5 A |
| 4,209,682 | 6/1980 | Rood | 200/159 R |

FOREIGN PATENT DOCUMENTS

| | | | |
|---|---|---|---|
| 1411761 | 10/1975 | United Kingdom | 200/159 R |

*Primary Examiner*—Ernest T. Wright, Jr.

*Attorney, Agent, or Firm*—Hill, Van Santen, Steadman, Chiara & Simpson

[57] ABSTRACT

A push-button key switch for keyboards, having an actuating member, and a helical spring which functions as a return spring for the actuating member and as a movable contact element. The helical spring comprises two sections, one of which is employed as the return spring, and which engages a seating surface on the actuating member. The other section of the spring extends beyond the seating surface and is adapted to engage a cooperable stationary counter-contact upon actuation of the actuating member. The switch may be readily designed as a single pole-single throw switch or a single pole-double throw switch, and may be designed to provide predetermined contact pressures between closed contacts.

13 Claims, 3 Drawing Figures

PUSH-BUTTON SWITCH, PARTICULARLY FOR KEYBOARDS OF TYPEWRITERS AND SIMILAR DEVICES

BACKGROUND OF THE INVENTION

The invention is directed to a push-button switch structure, particularly adapted for utilization in keyboards of typewriters and similar devices, for example teleprinter machines and data terminals, etc. The switch is provided with an actuating member which, upon actuation of the manual engageable key structure, is movable in opposition to the force of a helical spring extending between a portion of the housing structure for such a key and a seating surface on the actuating member of the switch, from an idle rest position into the working or actuated position, in which the spring forms the movable contact element and is brought into engagement with a cooperable stationary contact element upon movement of the actuating member.

A key structure utilizing a manually actuatable push button which is attached to the actuating member of a switch structure is already known, in which such push-bottom is arranged to be actuatable between an idle rest position and a working position, and utilizes a compression spring by means of which the push-button is returned from the working position into the rest position. U.S. Pat. No. 4,092,503 which corresponds to German OS No. 2,657,783 illustrate a push button switch of this type. In such known switch, the compression spring is provided with a longitudinally extended projection which, upon actuation, is brought into cooperative engagement with a counter-contact element. Such known switch has the disadvantage that, upon contacting engagement, the longitudinally extending projection stiffly or solidly strikes the cooperable counter-contact, with the possible production of contact chatter. As a result the cooperable counter-contact must be of a resilient type of construction. Such a push-button switch also is limited with respect to minimum height, as a result of the longitudinally extended projection, placing restrictions on the reduction in height of the key structure. Further, a relatively large number of component parts are required which in turn results in a more complicated structure and renders assembly more difficult.

Another example of a push-button switch utilizing a resilient spring member both as the contacting element as well as the biasing means for button returning means is illustrated in U.S. Pat. No. 3,842,230.

SUMMARY OF THE INVENTION

The invention has, among its objects, the production of a push-button switch which is particularly favorable ergonomically for the operator, and which utilizes a minimum of individual parts, enabling the switch to be manufactured with a low fabrication outlay.

This object is achieved by the use of a helical spring constructed with two sections, the first of which is designed in known manner and functions as a compression spring for the return of the actuating member of the key from the working position into the rest or idle position. The cooperable counter contact is disposed in the range of travel of the second section of the spring which extends beyond the first section.

A push-button switch constructed in accordance with the present invention is particularly small in its spatial dimensions and, in particular, enables the production of a switch structure in which the key height may be relatively small. The low key height is of particular importance for ergonomic reasons as the posture achieved upon key actuation is of less strain to the operator. This feature is particularly noticeable when the operator must operate input keyboards that are provided with key levels at different heights. The utilization of the invention enables the production of a push-button key structure in which it is possible to achieve a reduction in height of more than one-half of that of keys employed in practical operation prior to the invention. Irrespective of its small height, such a push-button key is very efficient and in particular is functionally stable, and at the same time may be very favorably manufactured costwise.

In addition, such push-button switch involves only a few individual parts which can be assembled in a simple manner, rendering manufacturing assembly possible in an automatic processing machine. The mechanical contacting is particularly stable and a low contact resistance exists between the closed contact elements. Further, the employment of the helical return spring achieves a uniform pressure characteristic upon actuation of the key. In an advantageous development of a push-button key, in accordance with the invention, the second section of the spring seats upon a surface of the actuating element disposed at the opposite side of the portion forming the seating surface upon which the first section of the spring is seated. This has the advantage that upon actuation of the push-button key, contact chatter or a dragging contact are avoided.

In a further advantageous development of the invention, the two sections of the helical spring possess different coil diameters, resulting in the advantage that the particular spring characteristics of the individual spring sections can be readily varied with respect to each other to provide optimum characteristics.

In a further advantageous development of the invention, the first spring section possesses a smaller coil diameter than the second spring section. This has the advantage that a particularly soft response action of the contacting is achieved due to the utilization of the spring section of larger diameter for the actual contacting, although the required minimum contact pressure is achieved upon contacting. It is particularly advantageous if the spring section possessing the greater diameter be also employed for achieving a damping action of the return stroke of the actuating element from its working position to its idle or rest position.

BRIEF DESCRIPTION OF THE DRAWING

In the drawing wherein like reference characters indicate like or corresponding parts.

DETAILED DESCRIPTION OF THE INVENTION

Figure 1:
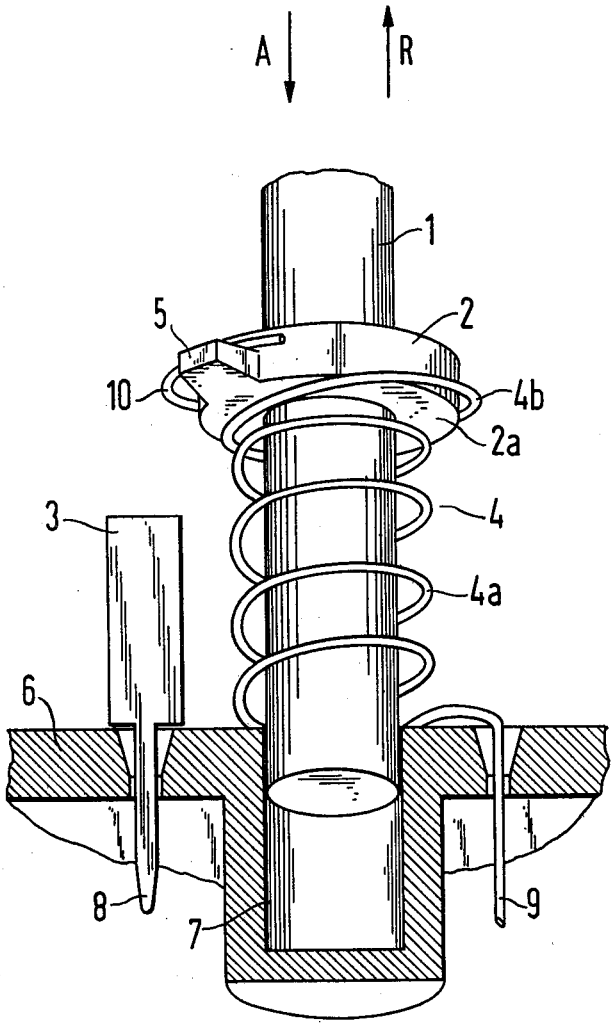
FIG. 1 is a isometric view of a portion of a push-button switch structure illustrating the basic construction and manner of functioning of a push-button switch embodying the invention.

The basic structure and principle involved of a switch constructed in accordance with the invention may be readily understood from a reference to FIG. 1. The push-button switch therein illustrated comprises an actuating member 1, of rod-like configuration, having its lower end adapted to be guided in a groove or bore 7 in the bottom wall of a switch housing 6, upon actuation of the switch by means of a suitable push button or key, not shown, attached to the upper end of the actuating member 1. The upper end likewise may be similarly guided in an upper portion (not shown) of the switch housing 6. Rigidly attached to the rod 1 adjacent the upper end thereof is a collar 2, the upper surface of which may form a stop adapted to limit the upward return movement of the rod 1, which by engagement thereof with the housing upper portion guiding means define the rest position of the actuating member 1. Simultaneously therewith, the lower surface 2*a* of the collar 2 provides a seat for engagement with a helical return spring 4. As clearly illustrated, the spring 4 comprises two sections 4*a* and 4*b* which possess different coil diameters. The first or lower spring section 4*a* possesses a relatively small coil diameter and functions as a compression spring, while the second section 4*b* of the spring 4 possesses a larger coil diameter and is utilized for a contacting function. The second spring section 4*b*, which comprises at least one coil turn, bears against a lug projection or dog 5, with such spring section 4*b* being disposed in prestressed engagement with the lug projection 5, which is rigidly connected to the collar 2 of the actuating member 1.

The amount of pre-stress is so determined that, upon engagement of such turn with a cooperable stationary contact 3, the desired contact pressure will exist. The characteristics of the spring 4 can readily be varied by suitable selection of coil diameters. As the section 4*b* has the greater coil diameter, a softer spring effect is achieved so that, upon making contact, a solid or hard contact engagement, with a pressure increase to the operator does not arise.

The spring 4 thus is employed as a movable contact element, with the lower end of the spring section 4*a* thus forming a switch terminal connection 9. The cooperable stationary counter contact 3, likewise having a terminal portion 8, is rigidly mounted in the housing 6 and is disposed in the path of the second spring section 4*b* when the switch is actuated. Advantageously, the counter-contact 3 is constructed in the form of a simple metal strip. The key housing 6 and the actuating member 1, together with the permanently attached collar 2 forming the seating surface 2*a*, as well as the lug projection or dog 5 can readily be constructed in a very simple manner from synthetic materials such as suitable plastic. To provide improved contacting, the contact surfaces of the counter-contact 3 and the cooperable coil portion 10 of the second spring section 4*b*, adapted to engage one another upon actuation of the switch, are coated with a layer providing increased conductivity, for example of gold or paladium.

In the position illustrated in FIG. 1, the actuating member 1 of the switch is in its rest or idle position, i.e. prior to actuation of an associated push-button or key (not shown). Upon actuation of the latter, the actuating member or rod 1 is moved in the direction of arrow A, by means of the associated key button and the finger pressure of the operator thereon. The actuating member 1 thereupon moves downward, guided by the bore 7 in the housing 6, and simultaneously compressing the spring section 4*a*. The collar 2 and rigidly attached lug projection or dog 5 likewise move downwardly with the actuating member 1 toward the counter-contact 3. As the projecting dog 5 moves past the contact surface formed by the top edge of the contact 3, the coil portion 10 of the spring section 4*b* engages such contact surface of contact 3, thereby at such time closing the switch and producing an electrically conductive connection over the contact terminal connection 9, the spring sections 4*a* and 4*b*, counter-contact 3 and the contact terminal portion 8. As a result of the prestressing of the spring section 4*b*, immediately upon contacting the coil portion 10 engages the counter contact 3 with the desired contact pressure. As a result, the contacting operation is achieved without chatter, etc. As the actuating member 1 continues its downward movement, the dog 5 is disposed below the contact surface of the counter-contact 3 whereby the coil portion 10 is disengaged from the dog 5 and rests freely on the contact surface of the counter-contact 3, eliminating disruption following operation resulting from unequal pressure, a decrease of finger pressure or a vibration upon actuation of the coil portion 10. The actuating member 1 may then arrive at its final working position with further motion may be limited, for example, either by the bottom surface of the guide bore 7 or by the spring section 4*a* having reached complete compression.

When the operator releases the push-button or key, the actuating member 1 returns from its working position into its rest position by action of section 4*a* of the spring 4 which thus applies pressure to the actuating member 1 in the direction of arrow R as a result of the action of the spring 4 on the collar 2. As the dog 5 moves past the contact surface of the counter-contact 3, contact engagement is positively interrupted and the spring section 4*b* is again seated on the dog 5 with its original predetermined pre-stress. The return motion of the actuating member 1 is limited either by the action of the spring section 4*a* or by the engagement of the collar 2 with an upper portion of the switch housing 6. The shock forces of the actuating rod 1 on the upper portion of the housing 6 upon impact therewith in limiting the return motion, advantageously may be damped by the spring section 4*b*.

Figure 2:
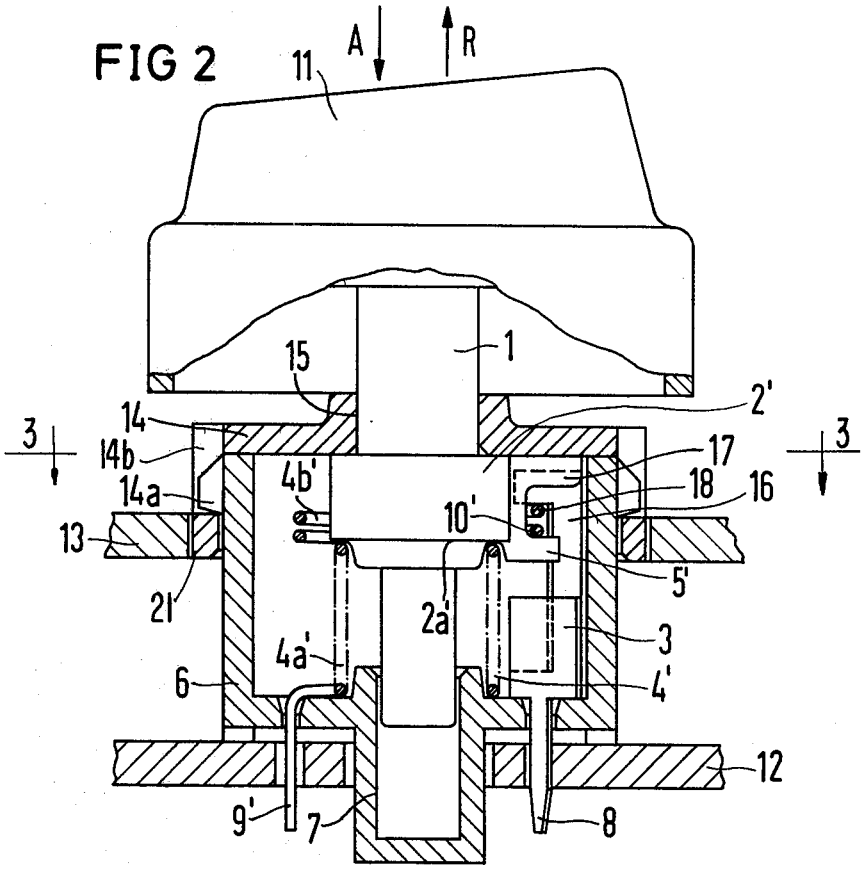
FIG. 2 is a vertical section through a practical embodiment utilizing the principles of construction illustrated in FIG. 1.
Figure 3:
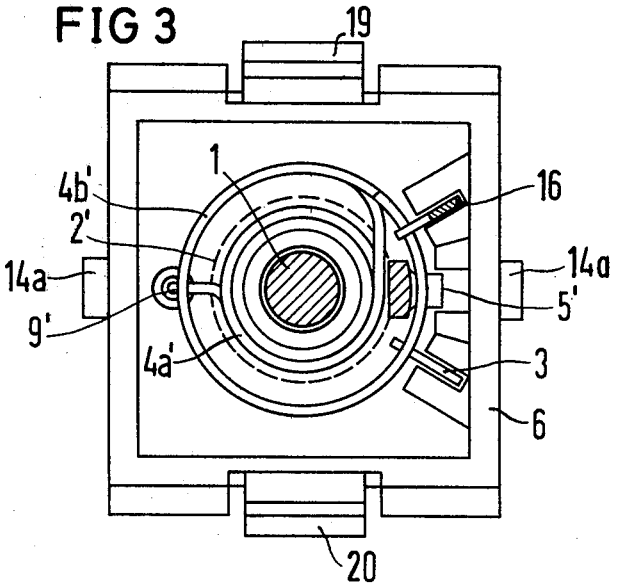
FIG. 3 is a transverse sectional view taken approximately on the line 3—3 of FIG. 2.

While FIG. 1 illustrates the construction and the manner of functioning of a push-button switch involving merely the closure of two contacts, i.e. a single pole-single throw switch, FIGS. 2 and 3 illustrate an advantageous exemplary embodiment of a push-button switch utilizing a movable or change-over contact which can be engaged with respective contacts in either rest or working position, i.e. a single pole-double throw switch.

Referring to FIGS. 2 and 3, the actuating member or rod 1 is provided at its upper end with a push button or key 11 suitably secured to the member 1. The latter is reciprocably movable in the key housing 6, illustrated in section, which contains all of the component parts required for the switching function, and which may be closed by a suitable cover member 14 which, in turn, may be positively locked to the housing 6 by suitable cooperable interlocking projections 14*a* on the housing 6 and cooperable catches 14*b* carried by the cover member 14. Likewise, the housing 6 may be snapped into a recess 21 of a carrier plate 13 and interlocked therewith by means of catch springs 19 and 20, illustrated in FIG. 3, with the carrier plate 13 absorbing the assembly and keying forces. A printed circuit board 12 may be disposed below the key housing 6, and the contact connecting terminals 8 and 9' of the switch soldered into a printed circuit on the board 12. It will be appreciated that the chamber formed by the key housing 6 and cover member 14 protects the various component parts and, in particular, the contacting portions thereof from external influences such as dust or vapors which arise, for example, in the automatic soldering of the printed circuits.

The actuating member or rod 1 is guided in the bore 7 in the lower portion of the housing 6 and a similar guide bore 15 in the cover member 14. As in the construction illustrated in FIG. 1, the first spring section 4*a*′ bears on the seating surface 2*a*′ formed by the underside of the collar 2′ and the second spring section 4*b*′ of the spring 4′ possesses a greater diameter than the spring section 4*a*′ and extends above the seating surface 2*a*′. As in the construction of FIG. 1, the opposite end of the spring section 4*a*′ bears upon the bottom surface of the key housing 6.

However, in this construction two projections or dogs 5′ and 17 are carried by the collar 2′ and, in addition to the stationary contact 3, a second stationary contact 16 is provided, both of which are suitably supported in the housing 6, with the contact 16 being provided with a connecting terminal (not shown) corresponding to the terminal 8 of the contact 3, with the respective terminals being suitably soldered or otherwise connected to the printed circuit board 12.

In the rest state, the upper coil of the spring section 4*b*′ engages the upper portion of the stationary contact 16 thus effecting a closed connection between the terminal 9′ and terminal 8 of the contact 16, which circuit extends over the terminal 9′ and spring sections 4*a*′ and 4*b*′. It will be particularly noted that in this instance the upper-most turn 18 of the second spring section 4*b*′ bears against the contact surface of the counter-contact 16 with a predetermined contact pressure determined by the spring formation, thus providing a desired contact pressure. In this position, as the contact surface of the counter-contact 16 is disposed below the underside of the projection or dog 17, the contact 16 is engaged by the spring section 4*b*′ with a pressure dependent upon the spring tension in the uppermost turn 18 of the spring section 4*b*′, which thus may be suitably predetermined to provide the desired contact pressure necessary for a faultless contacting. In the rest or idle state of the push button switch, the lowest turn 10′ of the second spring section 4*b*′, as in the construction of FIG. 1, seats upon the upper face of the dog 5′ with a desired predetermined pre-stress which is so selected that it corresponds to the necessary contact pressure in the working position of the switch.

Upon actuation of the key 11 in the direction A, the actuating member 1 travels downwardly, correspondingly compressing the first spring section 4*a*′, and at the same time also moving the second section 4*b*′ of the spring 4′. Continued movement ultimately results in engagement of the upper-most turn 18 of the second spring section 4*b*′ with the dog 17, whereby such uppermost turn will thereafter be disengaged from the contact surface of the stationary counter-contact 16. During the remainder of the movement of the actuating member 1 to its working position, the upper-most turn 18 of the second spring section 4*b*′ will be engaged with the lower surface of the dog 17 with a predetermined pre-stress corresponding to the desired contact pressure to be achieved in its contacting function.

As the actuating member 1 approaches it working position, the lowest turn 10 of the spring section 4*b*′ will seat upon the contact surface of the counter-contact 3. Again, the contact pressure with which the lowest coil or turn 10′ of the second spring section 4*b*′ rests upon the contact surface, corresponds to the desired pre-stress with which such coil or turn 10′ engaged the dog 5′. However, as in the previous construction, it is therefore necessary that the upper face of the dog 5′ be disposed below the contact surface of the counter-contact 3 in the working position of the switch. Thus, in such working position, an electrically conductive connection is provided between the terminals 8 and 9′ over the first spring section 4*a*′, the lowest turn 10′ of the second spring section 4*b*′ and the counter-contact 3.

Upon release of the push button or key 11, the latter returns to its rest position due to the spring force of the first spring section 4*a*′, and during return movement of the actuating member 1 in the direction R, the dog 5′ will lift the lowermost turn 10′ of the spring section 4*b*′ off of the contact surface of the counter-contact 3. The bottom-most turn 10′ thereof thus is again seated upon the dog 5′ with the desired pre-stress. Upon attainment of the rest position, the uppermost turn 18 of the second spring section 4*b*′ again is seated on the contact surface of the counter-contact 16 with the required contact pressure corresponding to its pre-stress with the dog 17, which is achieved as the dog 17 moves above the contact surface of the counter-contact 16. The upward motion of the actuating member 1 is limited by engagement of the upper face of the collar 2′ with the cover member 14. In the rest state, the conductive connection thus extends over the contact 16, spring sections 4*a*′ and 4*b*′ and terminal 9′.

It will be noted that the spring force resulting from the prestressing of the upper spring section 4*b*′ with respect to the contact 16, such section 4*b*′, following engagement with the contact 16 and disengagement from the dog 17, tends to oppose the remaining movement of the actuating member 1 to its final rest position, thus effectively damping the impact thereof with the cover member 14.

Although we have described our invention by reference to particular illustrative embodiments, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim as our invention:

1. A push-button switch, particularly for keyboards in typewriters and similar devices, comprising an actuating member movable from a rest position to a working position, a stationary contact, and a continuous helical spring member which forms a movable contact cooperable with said stationary contact, said spring member having two connected spring sections, a first spring section which is arranged to engage and apply force biasing said actuating member to its rest position and a second spring section which is arranged to resiliently engage said stationary contact when said actuating member reaches an intermediate position during movement thereof from its rest to its working position, wherein said second spring section is tensioned upon continuation of movement of said actuating member past said intermediate position to provide firm seating engagement of said second spring section with said stationary contact and said second spring section is so disposed relative to said actuating member and said first spring section that said second spring section attenuates final return movement of said actuating member into its rest position.

2. A push-button switch according to claim 1, wherein said second spring section is prestressed and said actuating member is provided with means engageable with said second spring section for supporting said second spring section in such pre-stressed condition prior to its engagement with said stationary contact whereby said first spring section is stressed upon compression and said second spring section is stressed by tension.

3. A push-button switch according to claim 1, wherein the first spring section is of one diameter and the second spring section is of a different diameter.

4. A push-button switch according to claim 3, wherein said first spring section possesses a relatively smaller coil diameter and said second spring section possesses a relatively larger coil diameter.

5. A push-button switch according to claim 1, wherein said second spring section comprises at least one turn.

6. A push-button switch according to claim 1, wherein said actuating member is reciprocable along an axis and provided with a seating surface, facing said first spring section, upon which the connected end of said first spring section is seated, said actuating member having a projection extending laterally therefrom upon which a first turn of the second spring section adjacent the first spring section rests in pre-stressed condition, prior to engagement of said second spring section with said stationary contact.

7. A push-button switch according to claim 6, wherein said stationary contact and said projection are so disposed relative to said second spring section, that said second spring section is disengaged from said projection following engagement of said second spring section with said stationary contact and continued movement thereafter of said actuating member in the working direction.

8. A push-button switch according to claim 6, wherein said actuating member is provided with a further projection axially spaced along said actuating member above said projection and extending laterally therefrom, between which projections said second spring section extends whereby respective ends of said second spring section may rest in pre-stressed relation in engagement with said projections, a further stationary contact, disposed in the return path of said second spring section as said actuating member returns to its rest position from its working position, said further stationary contact being engageable with a free end turn of said second spring section prior to such return of said actuating member to its rest position, whereby said free end turn in disposed in pre-stressed engagement with said further stationary contact when said actuating member is in its rest position.

9. A push-button switch according to claim 8, wherein contact portions of said stationary contact and further stationary contact and cooperable portions of said second spring section are coated with a material increasing the conductivity therebetween.

10. A push-button switch according to claim 2, wherein said second spring section and said stationary contact are so disposed that the pre-stressing of the second spring section corresponds to the desired contact pressure therebetween when said actuating member is moved to its working position.

11. A push-button switch according to claim 8, wherein the two connected spring sections, stationary contacts and said projections are disposed in a container forming a closed chamber.

12. A push-button switch according to claim 11, wherein said container is open along one side thereof, a cover member cooperable with said container to close said open side thereof, and latchable means for retaining said container and cover member in assembled relation.

13. A push-button switch according to claim 11, wherein said container is formed with a guide portion for reciprocatingly receiving a lower end of said actuating member in guided relation during movement of said actuating member between its working and rest positions.

* * * * *